US005643481A

United States Patent [19]

Brotzki et al.

[11] Patent Number: 5,643,481

[45] Date of Patent: Jul. 1, 1997

[54] DOUBLE BOWL ELECTRIC COOKTOP COOLING

[75] Inventors: Bernard J. Brotzki, Dayton; David N. Corson, Washington Township, Montgomery County, both of Ohio

[73] Assignee: Whirlpool Corporation, Benton Harbor, Mich.

[21] Appl. No.: 271,997

[22] Filed: Jul. 8, 1994

[51] Int. Cl.[6] ..... H05B 3/68; F24C 5/00

[52] U.S. Cl. ..... 219/461; 126/51

[58] Field of Search ..... 219/443, 455, 219/458, 459, 460, 461, 467; 126/217, 220, 51, 39 M

[56] References Cited

U.S. PATENT DOCUMENTS

| | | | |
|---|---|---|---|
| 1,706,015 | 3/1929 | Wiegand . | |
| 2,260,793 | 10/1941 | Russell | 219/461 |
| 2,724,043 | 11/1955 | McOrily | 219/455 |
| 2,861,563 | 11/1958 | Jensen . | |
| 3,165,201 | 1/1965 | Woodman | 126/39 M |
| 3,898,430 | 8/1975 | Sego | 219/461 |
| 3,987,275 | 10/1976 | Hurko . | |
| 4,009,795 | 3/1977 | Hurko et al. | 219/461 |
| 4,458,661 | 7/1984 | Mulay | 219/461 |
| 4,480,176 | 10/1984 | Raskov . | |
| 4,517,454 | 5/1985 | Mantelet | 219/455 |
| 4,862,795 | 9/1989 | Hawkins . | |
| 4,884,551 | 12/1989 | Hait | 126/9 R |
| 5,079,408 | 1/1992 | Jordan . | |

*Primary Examiner*—Teresa J. Walberg
*Assistant Examiner*—Sam Paik
*Attorney, Agent, or Firm*—Hill, Steadman & Simpson

[57] ABSTRACT

A double burner bowl assembly for a cooking appliance having a cooktop surface with burners disposed in burner holes therein, said assembly having a lower bowl with a support shelf and a trim ring. The trim ring is disposed in the burner hole so as to support the double burner bowl assembly. The assembly further has an upper bowl with a lip about its peripheral edge supported by the support shelf of the lower bowl.

15 Claims, 2 Drawing Sheets

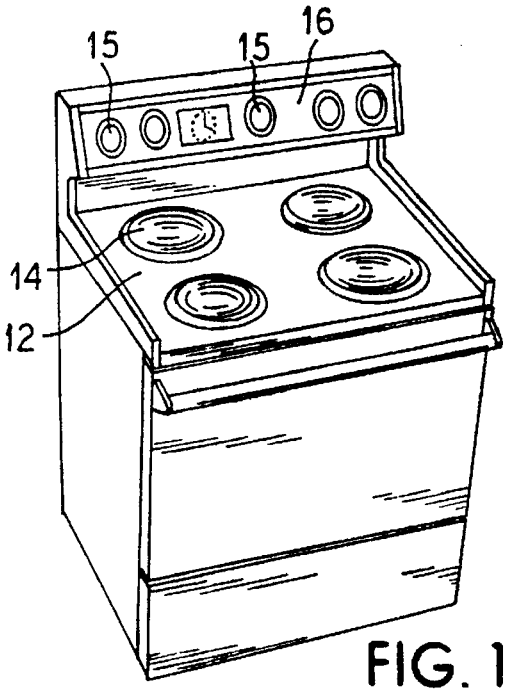
FIG. 1
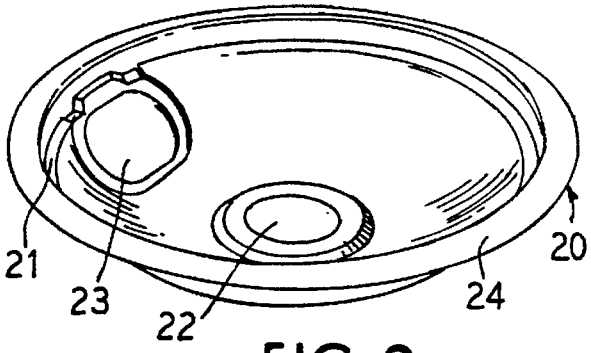
FIG. 2
FIG. 3
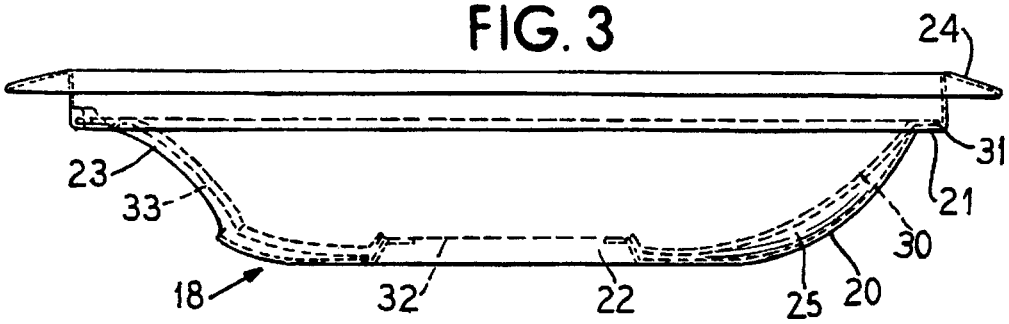
FIG. 4
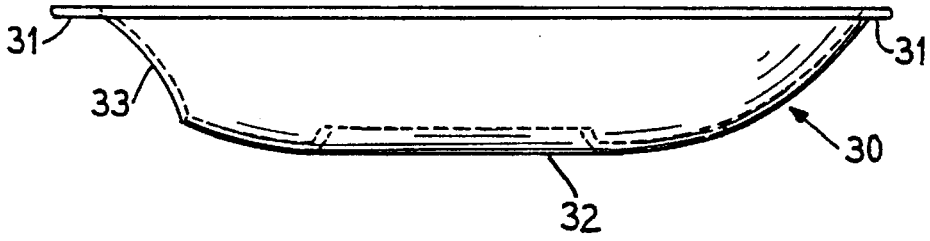

DOUBLE BOWL ELECTRIC COOKTOP COOLING

BACKGROUND OF THE INVENTION

The present invention relates to appliances, such as ranges, cooktops, and the like and more particularly to burner bowls located on the cooktop surface.

Household appliances, such as ranges, cooktops and the like have electric burners located on the surface of the cooktop. Each burner is provided with a burner bowl which is mounted in the cooktop surface beneath the heating unit itself. The purpose of the burner bowl is to reflect the heat back up onto the cooking vessel sitting on the burner. In general, chrome burner bowls reflect a large majority of the heat produced by the coil elements back onto the cooking vessel. The reflection by the bowl of the downward heat back up onto the pan prevents some of the heat from being conducted to the surface of the cooktop.

Since the cooktop surface of the range is commonly touched by the user and utensils are placed thereon, safety considerations dictate that the cooktop surface be kept relatively cool. Also, another concern, with the advent of black and other color cooktop surfaces used in designer kitchens, is that the chrome burner bowls have been found to be non-aesthetically pleasing.

U.S. Pat. No. 5,079,408 relates to an insulated drip pan which consists of an upper pan and lower pan with insulation in between. The two pans and the insulation cooperating together reduce both the time and energy required to cook food in a cooking vessel located on the range. The insulating material prevents heat radiated downward from the heating element from being radiated out into the area surrounding the drip pan assembly. Instead, heat radiated into the drip pan assembly is radiated back up toward the cooking vessel located on the heating element thereby decreasing both heating time and energy required to heat the cooking vessel.

U.S. Pat. No. 4,862,795 relates to a reflector pan mounted beneath a grill unit. The reflector has a slot on its outer edge to draw cooling air under the reflector. The reflector pan has sidewalls to shield the area laterally adjacent to the grill area from the radiant energy of the heating element. The reflector pan has slots formed therein to permit air flow therethrough. This arrangement allows air to be drawn by convection from above the cooktop member downwardly through the air gap into the area between the drip pan and the reflector pan when the heating element is energized. The cooling effect of this air flow, together with the radiation shielding effect of the reflector pan sidewalls, attempts to prevent excessive ambient temperatures on the cooktop surface adjacent to the grill area and in the area between the sidewalls of the drip pan. The arrangement is used to protect adjacent counter tops and cabinetry.

U.S. Pat. No. 1,706,015 relates to an electric heating device having a chamber beneath the heating element. The chamber has a flat bottom and a polished sheet metal plate located above the flat bottom with an air gap therebetween.

SUMMARY OF THE INVENTION

The present invention provides a simple, yet effective solution to reduce the heat energy transfer from an electric burner on a range to the cooktop surface by using a double burner bowl assembly beneath each heating element. The double burner bowl assembly could be implemented on a production basis or used as a field retrofit kit for customers desiring a cooler cooktop surface for their ranges.

The objects of the present invention are inventively achieved in a double burner bowl assembly for a cooking appliance having a cooktop surface with burners disposed in burner holes therein, said assembly having a lower bowl with a support shelf and a trim ring. The trim ring is disposed in the burner hole so as to support the double burner bowl assembly. The assembly further has an upper bowl with a lip about its peripheral edge disposed on the support shelf of the lower bowl. The upper bowl preferably has a color finish so that it aesthetically complements the color finish of the cooktop.

BRIEF DESCRIPTION OF THE DRAWINGS

FIG. 1 is a perspective view of a free-standing range illustrating an electric cooktop on which a double bowl embodying the principles of the present invention could be utilized.

FIG. 2 is a perspective view of a lower burner bowl apparatus of the present invention.

FIG. 3 is a side view of a double bowl of the present invention.

FIG. 4 is a side view of an upper bowl of the present invention.

DESCRIPTION OF THE PREFERRED EMBODIMENTS

Figure 5:
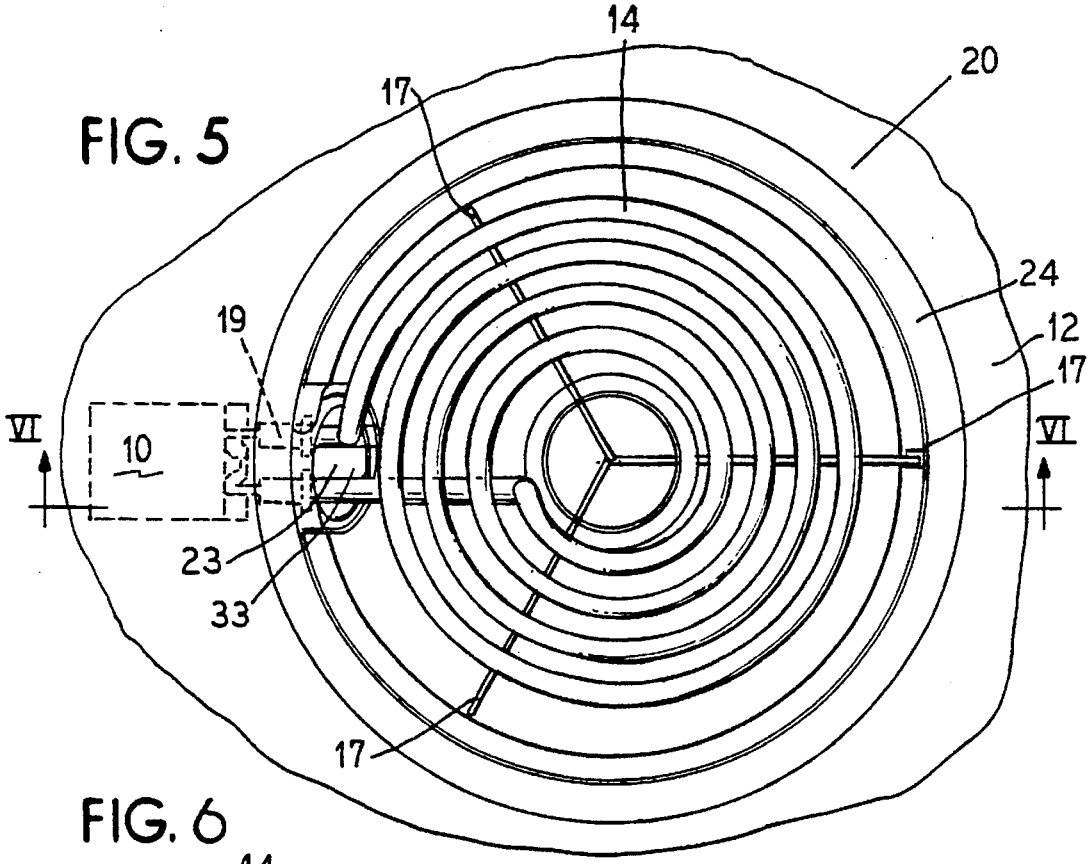
FIG. 5 is a top view of an electric coil burner under which a double bowl of the present invention could be used.

FIG. 1 illustrates an appliance generally at 10 which is depicted as a free-standing electric range, although the present invention can be utilized with other types of appliances, such as stand-alone cooktops, hot plates and the like. Also, the appliance 10 could be a gas range in an embodiment. The range 10 has a top cooking surface 12 which includes a plurality of electric coil-type heating elements 14 controlled by control knobs 15 positioned on a control panel 16. An oven including an oven chamber (both of which are not shown) are disposed beneath the top cooking surface 12 and behind the door 11. Four such heating elements 14 are shown in FIG. 1, one of which is shown in greater detail in FIG. 5.

FIG. 2 illustrates a perspective view of a lower burner bowl 20 of the present invention. As illustrated, the lower burner bowl 20 comprises a support shelf 21, a center hole 22, a heating element access hole 23, and an integral trim ring 24. The center hole 22 may or may not be included in an embodiment of the lower bowl 20. The center hole 22 provides means by which heat can be vented from the oven, up through the center hole 22 of the double burner bowl assembly 18. The lower burner bowl 20 preferably is of a metal construction with a chrome finish.

FIG. 3 illustrates a double burner bowl assembly 18 of the present invention. The double burner bowl assembly 18 has the lower burner bowl 20 and an upper burner bowl 30. The lower burner bowl 20 has the contact shelf 21 on which rests a lip 31 of the upper burner bowl 30. The upper burner bowl 30 is preferably has a black porcelain finish or other finish that aesthetically complements the cooktop surface decor. The upper burner bowl 30 also has a center hole 32 through which heat from the oven may pass. In other words, at least some heat generated in the oven will emanate upward toward the range top surface 12. The co-aligned center holes 22, 32 enable this heat emanated from the oven to be released upward through the double burner bowl assembly 18. Further, an integral trim ring 24 of the lower burner bowl 20 supports the weight of the double burner bowl assembly 18 on the cooktop surface 12 of the range 10. As illustrated, the upper burner bowl 30 is supported a distance above the lower burner bowl 20 so that an air gap 25 is formed therebetween. The air gap 25 provides a benefit of allowing heat to radiate off the lower burner bowl 20 to help keep the surface 12 of the range 10 cooler. The double bowl assembly is located in a burner hole 13 in the range 10 supported on surface 12.

FIG. 4 illustrates the upper bowl 30 of the double burner bowl assembly 18 of the present invention. As illustrated, the upper burner bowl 30 has the same general shape as the lower burner bowl 20 except for a few modifications. One of these modifications is the lip 31 which rests upon the contact shelf 21 of the lower burner bowl. Also illustrated is the center hole 32 through which heat may pass. Also illustrated is a heating element access hole 33, which provides access for the heating element 14 to be connected to the range 10.

FIG. 5 illustrates an example of a heating element 14 in the environment of the cooktop surface 12 of the range 10. As illustrated, three support rails 17 give rigidity to the heating element 14 and provide for mounting the heating element 14 on the double burner bowl assembly 18. The heating element 14 obtains its electrical power from the range 10 via a heating element connector pins 19 that plug into connector 196 of the range 10 at each of the burner holes 13. Also, FIG. 6 further illustrates the mounting of the heating element 14 in the range 10.

Figure 6:
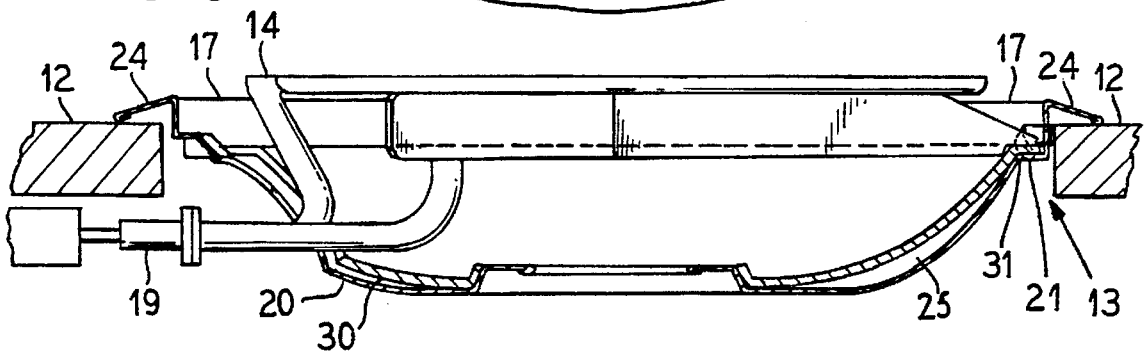
FIG. 6 is a side sectional view of the present invention taken along section line VI—VI of FIG. 5.

As illustrated in FIG. 6, the heating element 14 is also supported on the support shelf 21 of the lower burner bowl 20. To this end, the plurality of support rails 17 are provided under the heating element 14 such that the rails 17 carry the weight of the heating element 14 to the support shelf 21 of the lower burner bowl 20. The heating element 14 is thereby located above the upper bowl 30. Thus, the lower burner bowl 20 is positioned within the burner hole 13 in the cooktop 12 so that the lower bowl 20 trim ring 24 supports both the double burner bowl assembly 18 and the heating element 14.

The construction of the bowls of the present invention is similar to the current construction of other known burner bowls except that a second bowl is located inside the first. The bottom bowl 20 is made with a reflective surface, for example, chromed metal. The inner bowl 30 can be made with whatever surface is desired, such as black porcelain. The selection of the inner bowl material may be based upon both aesthetic and functional reasons. For example, when used on a black cooktop, it is more aesthetically pleasing to have an inner bowl with a black ceramic surface than a chromed one as in current ranges. Also, the thermally reflective outer bowl 20 reflects the heat back up to and through the thermally transmissive inner bowl 30 to prevent the conduction of heat to the cooktop surface 12.

Specifically, this advantageous and inventive cooktop surface temperature reduction using the double burner bowl assembly 18 has a cooling effect of 7°–10° C. on the surface of the cooktop in areas that are most often in contact with the user. During several trials of tests conducted by the inventors herein, the double burner bowl assembly 18 performed effectively to reduce the cooktop surface temperature without causing any unforeseen problems or necessitating any changes to the range. As mentioned above, the present invention can be used in current burner bowl designs as well as in retrofitting existing ranges for cooktop cooling.

Figure 7:
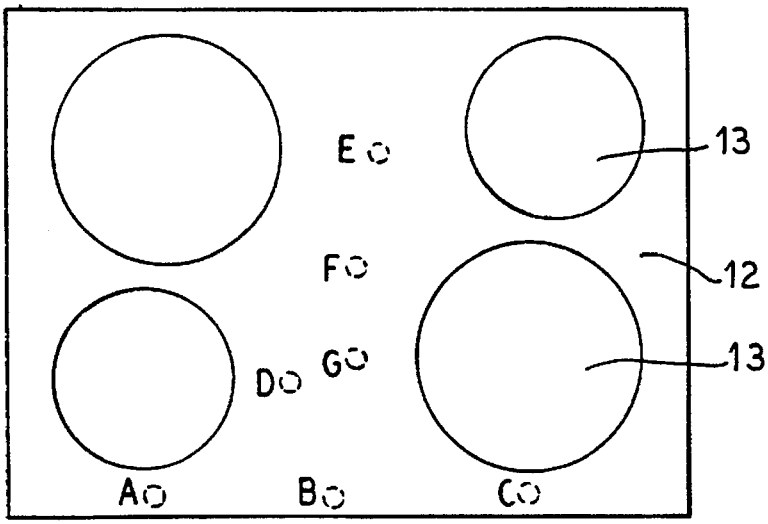
FIG. 7 is a cooktop surface illustrating thermocouple locations during a cooktop heating test of the present invention.

A summary of the test results conducted by the inventors as to the cooling effect of the bowls on the cooktop surface follows. FIG. 7 shows exemplary thermocouple locations on the cooktop surface used during the cooktop testing. As shown in FIG. 7, thermocouples were located in the cooktop regions commonly touched by the user. For example, thermocouples A, B, and C are all located approximately ¾ of an inch from the front of the cooktop. Thermocouple F is located in the center of the range, and thermocouples E and G are centered between burners.

During the above testing, the double burner bowl assembly 18 used included a lower bowl 20 of chromed metal and an upper bowl 30 having a black porcelain surface. It was observed during the testing that the cooling effect was substantial at the center and rear areas of the cooktop. This observation is significant because the center and rear areas of a cooktop are usually more difficult to cool on an electric range. In addition, the cooling effect was observed on the front edge of the cooktop. Also, the heat was evenly distributed across the cooktop surface, starting at the heating elements and spreading evenly outward.

As is apparent from the foregoing specification, the invention is susceptible of being embodied with various alternations and modifications which may differ particularly from those that have been described in the proceeding specification. It should be understood that we wish to embody within the scope of the patent warranted hereon, all such modifications as reasonably and properly come within the scope our contribution to the art.

The embodiments of the invention in which an exclusive property or privilege is claimed are therefore defined as follows:

1. A double burner bowl assembly for a cooking appliance having a cooking surface with burners disposed in burner holes therein, comprising:

a thermally-reflective lower bowl having an access hole to allow connection of the burner in the burner hole, a center opening, support shelf and a trim ring, said trim ring sized to surround said burner hole so as to support said double burner bowl assembly; and a thermally-transmissive upper bowl having a continuous lip about its peripheral edge except at above said access hole of said lower bowl, said lip sized to rest on said support shelf of said lower bowl, said lip constructed and arranged so that an air gap is formed between said upper and lower bowls, said upper bowl having a smooth, continuous upper surface free of any upward projections extending above the lip.

2. The double burner bowl assembly according to claim 1, wherein said upper bowl has a black porcelain surface.

3. The double burner bowl assembly according to claim 1, wherein said lower bowl is constructed of a chromed metal.

4. The double burner bowl assembly according to claim 1, wherein said upper bowl has a finish which is aesthetically complementary to a cooktop surface in which it is disposed.

5. The double burner bowl assembly according to claim 1, wherein at least one of said burners is supported by said ledge of said lower bowl.

6. The double burner bowl assembly according to claim 1, wherein said support shelf comprises an annular horizontal surface.

7. The double burner bowl assembly according to claim 1, wherein said trim ring is formed at an upper edge of said lower bowl.

8. The double burner bowl assembly according to claim 1, wherein said lower bowl has a greater diameter than said upper bowl.

9. An electric range, comprising:

a cooktop surface having a plurality of electric burners disposed in burner holes therein;

an oven located beneath the cooktop surface, the oven heating air and being disposed beneath the cooktop surface;

a thermally-reflective lower burner bowl further comprising a peripheral flange, a recessed peripheral ledge having a diameter less than said flange, and an access hole for permitting connection of said burner to said range, said lower burner bowl having a lower center opening to allow air heated by the oven to pass upward through the center opening; and a thermally-transmissive upper burner bowl further comprising an access hole for permitting connection of said burners to said range and a peripheral lip for supporting said upper bowl on said ledge of said lower bowl, said peripheral lip being continuous except at said access hole, the upper burner bowl having an upper center opening in alignment with the lower center opening of the lower bowl to allow air heated by the oven to pass upward through the upper center opening.

10. The electric range of claim 9, wherein said burners and said lower bowl are supported by said ledge of said lower bowl.

11. The electric range of claim 9, wherein said peripheral flange of said lower bowl supports one of said burners and further supports said upper bowl in said burner hole.

12. A double burner bowl assembly for use with a cooking appliance comprising:

a thermally-reflective first bowl having a concave bowl shaped wall of a first diameter and a peripheral flange surrounding said bowl shaped wall for supporting said first bowl relative to said appliance, said first bowl having an access hole to allow connection of a burner and a center aperture, and a thermally-transmissive second bowl having a concave bowl shaped wall of a second, smaller diameter and a peripheral flange surrounding said second bowl shaped wall for supporting said second bowl within said first bowl and relative to said appliance, said peripheral flange constructed and arranged so that an air gap is formed between said first and second bowls.

13. The double burner bowl assembly according to claim 12, wherein said peripheral flange of said second bowl has a diameter less than a diameter of said peripheral flange of said first bowl.

14. The double burner bowl assembly according to claim 12, wherein said first bowl has a support shelf formed therein and said second bowl peripheral flange is sized to be received on said support shelf.

15. The double burner bowl assembly according to claim 14, wherein said support shelf is formed in said bowl shaped wall.

* * * * *